United States Patent [19]

Brooks

[11] Patent Number: 5,002,035

[45] Date of Patent: Mar. 26, 1991

[54] ARCHERY BOW COCKING APPARATUS

[76] Inventor: Scott T. Brooks, W279 N1966 Hwy. SS, Pewaukee, Wis. 53072

[21] Appl. No.: 443,601

[22] Filed: Nov. 30, 1989

[51] Int. Cl.[5] ..... F41B 5/18

[52] U.S. Cl. ..... 124/23.1; 124/35.2; 124/88

[58] Field of Search ..... 124/35.2, 23.1, 25.6, 124/88, 40, 86, 24.1, 31, 35.1, 90; 403/100, 102, 145

[56] References Cited

U.S. PATENT DOCUMENTS

| | | | |
|---|---|---|---|
| 2,664,078 | 12/1953 | Irwin | 124/24.1 |
| 2,815,016 | 12/1957 | Kellogg | 124/35.2 |
| 2,982,279 | 5/1961 | Pursley | 124/35.2 |
| 3,446,200 | 5/1969 | Gross | 124/24.1 |
| 3,512,512 | 5/1970 | Wentz | 124/24.1 |
| 3,563,592 | 2/1971 | Preston | 403/102 X |
| 3,750,641 | 8/1973 | Ramsey | 124/23.1 |
| 3,794,012 | 2/1974 | Ramsey | 124/90 X |
| 3,895,621 | 7/1975 | Kellogg | 124/24.1 |
| 4,041,925 | 8/1977 | Barrick | 124/35.2 |
| 4,066,051 | 1/1978 | Alban | 124/86 |
| 4,466,418 | 8/1984 | Jones | 124/35.2 |
| 4,471,747 | 9/1984 | Nishioka . | |
| 4,527,579 | 7/1985 | Knotter et al. | 403/100 X |
| 4,577,612 | 2/1986 | Zell | 124/41.1 |
| 4,615,326 | 10/1986 | Rathbun | 124/88 |
| 4,672,945 | 6/1987 | Carlton | 124/88 X |
| 4,886,039 | 12/1989 | Wagner . | |
| 4,919,107 | 4/1990 | Bunts | 124/86 X |

*Primary Examiner*—Peter M. Cuomo

*Attorney, Agent, or Firm*—Robert T. Johnson

[57] ABSTRACT

Disclosure is made of apparatus to facilitate cocking of an archery bow.

The apparatus comprises a forward and an aft leg joined together by a spring loaded hinge and is offset from the bow by offset angle bends in the forward leg, and there is a nock in the rear of the aft mount leg to hold the bow string in a partly cocked position, when the bow is fully cocked, the bow string is released from the nock in aft mount leg and the spring loaded hinge swings the aft mount leg outward away from the bow string to allow shooting of the bow and arrow mounted therein.

5 Claims, 4 Drawing Sheets

ARCHERY BOW COCKING APPARATUS

BACKGROUND OF THE INVENTION

Shooting an arrow from a bow requires inserting an arrow against the bow string, then drawing the bow string and arrow at the time of shooting or firing the arrow.

Loading the arrow on to the bow and inserting the bow string into the arrow nock, then drawing the bow string and arrow when hunting game, can be a time-consuming and perhaps a noisy affair. These problems can be overcome by the archery bow cocking apparatus of this invention.

SUMMARY OF THE INVENTION

This invention provides a bow cocking apparatus to hold the bow string and nocked arrow in a partly cocked position.

The cocking apparatus is released from its bow string holding position by full cocking of the nocked arrow on the bow string, to shoot the arrow.

The cocking apparatus of this invention can be described in part as two leg segments, front and aft, connected by a hinge operable by a compression spring. The spring operates to swing the nocked aft leg mount away from the bow string on full cocking of the bow and nocked arrow for shooting.

EXPLANATION OF INVENTION

This invention is to disclose apparatus for attachment to an archery bow to hold the string of the bow in a partly cocked position at from fifty to ninety percent of full cocking, preferably at seventy-five percent of full cock.

The partly cocked bow of this invention will allow an arrow to be nocked in this partly cocked position to allow for ease in shooting the arrow mounted in the partly cocked bow.

An object of this invention is to disclose apparatus comprising a bow cocking leg forward mount having a front offset angle and a rear offset angle and the front end of the leg forward mount being threaded and inserted through a hole in the bow handle and rigidly mounted therein by means of a nut on the threaded end of the leg, and a bow cocking apparatus hinge, spring and stop assembly attached to the rear end of the leg forward mount and a bow cocking aft mount leg attached to the bow cocking apparatus hinge spring and stop assembly and a nock is provided on the rear end of the aft leg mount.

The hinge, spring and stop assembly connecting the forward leg and the aft leg of the bow cocking apparatus is an assembly of two pivoting segments mounted on a hinge pin, one of which segments is a male segment mounted on the rear of the forward leg mount and the other segment being the female segment mounted on the front of the aft leg mount, and a hinge pin connecting the male and female segments, with a coil spring chamber extending from the male end into the female end and a coil spring mounted in the coil spring chamber. The male end of the hinge segment has an angle of about 15 degrees from perpendicular to the long axis of the hinge segment. The shoulder on the male end also has an angle of about 15 degrees. The female end of the hinge segment has an angle of about 25 degrees from perpendicular to the long axis of aft leg mount and the shoulders of the female end of the hinge segment have an angle of about 25 degrees. A bow cocking safety lock sleeve is mounted to reciprocate over the hinge mount and away from the hinge mount to allow pivoting of the bow cocking aft mount leg, on release of the bow string from the nocked bow cocking aft mount leg on full cocking of the bow.

An object of this invention is to disclose apparatus for partly cocking an archery bow, the apparatus assembly being a bow cocking leg forward mount, and a bow cocking aft mount leg, the forward and aft mount legs joined by connecting to a hinge which hinge limits the outward movement of the aft mount leg on release of the bow string from the nock on the rear of the aft leg, on full cocking.

Another object of this invention is to disclose a bow cocking safety lock sleeve mounted around the hinge connecting the forward and aft mount legs and the safety lock sleeve mounted to reciprocate as desired, over the hinge to prevent actuation, of the hinge by the compression coil spring to allow outward movement of the aft mount leg on release of the nocked aft mount leg on full cocking of the bow.

Another object of this invention is to disclose bow cocking apparatus comprising a bow and bow string and a bow cocking apparatus assembly of a bow cocking leg forward mount and a bow cocking aft mount leg and the aft mount leg attached to the bow cocking leg forward mount by a hinge attached to the rear end of the leg forward mount and the front end of the aft mount leg, and the hinge comprised of two segments, one segment having a male section and the other hinge segment having a female section and a hinge pin connecting the two hinge segments with a coil spring chamber extending between the hinge segments and a compression coil spring mounted in the coil spring chamber and the coil spring chamber offset inward from the hinge pin toward the bow string and a bow string mount nock on the rear of the aft mount leg and the leg forward mount of the bow cocking apparatus attached offset to the handle of the bow, and the bow string mount nock on the rear of the aft mount leg extending to the bow string in partly cocked position, and the compression coil spring forcing the aft leg mount outwards on release of the bow string from the nock of aft mount leg.

PRIOR ART

U.S. Pat. No. 2,664,078 to Irwin for Arrow Shooter. This patent discloses a string draw bar and draw bar catch to hold the arrow in a bow cocked position, and a trigger on the bow string latch of the arrow chuck to release the bow string to shoot the arrow.

U.S. Pat. No. 2,982,279 to Pursley for Archer's Aid. Disclosure is made in this patent of a telescoping rod and latching means on the rod to hold the bow and arrow in a cocked position and release of the bow string by a trigger action.

U.S. Pat. No. 3,446,200 to Gross for Natural Archery Assist Device, which discloses means for retaining a long bow and arrow in a taut shooting position and including a mechanism for manually releasing the taut bow string to shoot the arrow.

U.S. Pat. No. 3,895,621 to Kellogg for Means Mounted On A Bowstring Tensioning Device For Releasably Holding A Bowstring. Disclosure is made in this patent of a trigger release device and includes a bracket pivotally mounted on the bow handle and supporting a pair of rods parallel with an arrow fitted to the bow and string and a trigger device for release of the cocked bow string and arrow.

U.S. Pat. No. 4,041,925 to Barrick for Bowstring Release Device. Disclosure is made in this patent of a hand grip with a bow string holding and release mechanism comprising an arrow draw tube and a lock for retaining the draw tube in a bow flexed position.

U.S. Pat. No. 4,577,612 to Zell for Arrow Holder. This patent discloses a trigger actuated arrow holder, with the arrow in a bow cocked position for release by a trigger action.

LEGENDS OF DRAWINGS

1—Bow flex arms.
3—Bow cocking apparatus assembly.
4—Bow string.
4'—Phantom bow string in full cocked position.
5—Arrow.
6—Nock in rear of aft leg mount.
7—Nocked arrow full cocked bow.
7'—Bow string line of travel.
8—Thread on forward end of forward leg.
9—Bow cocking apparatus mount on bow handle segment.
10—Nut threaded on thread section 8.
11—Mount clamp on bow handle for cocking apparatus.
12—Bow handle grip.
13—Front offset angle on front leg of cocking apparatus.
14—Rear offset angle on front leg of cocking apparatus.
16—Bow handle.
17—Compound bow-arrow and cocking apparatus.
18—Bow string mount nock on rear of aft leg.
19—Bow cocking apparatus spring, hinge and stop assembly.
20,20'—Hinge pin holes.
21—Bow cocking aft mount leg.
22—Bow cocking leg forward mount.
23—Bow cocking safety lock sleeve.
24—Bow cocking safety lock sleeve tab.
25—Pin stop for safety lock sleeve.
26—Slot in safety lock sleeve.
27—Hinge pin connecting forward and aft leg mount.
28—Compression coil spring.
29,29'—Coil spring chamber.
30—Male stop face on rear of forward leg.
31—Forward female shoulder faces of bow cocking aft mount leg.
32—Angle shoulder female stop face of aft bow cocking leg.
33,33'—Angle of male shoulder stop face of forward mount bow cocking leg.
34—End view of rear of front leg mount.
35—Hole for stop pin of safety lock sleeve.
36—Hex head.
37—Straight bow cocking leg forward mount.
38—Bracket mounted on bow handle.
39—Base of bracket 38.
40—Arc on aft leg mount hinge segment.
41—Boundary of arc 40.
42—Boundary of arc 40.
43—Screws mounting bracket 38 on bow handle.
44—Pin for slip fit of leg forward mount to hinge section.

DETAILED DESCRIPTION OF DRAWINGS

Figure 1:
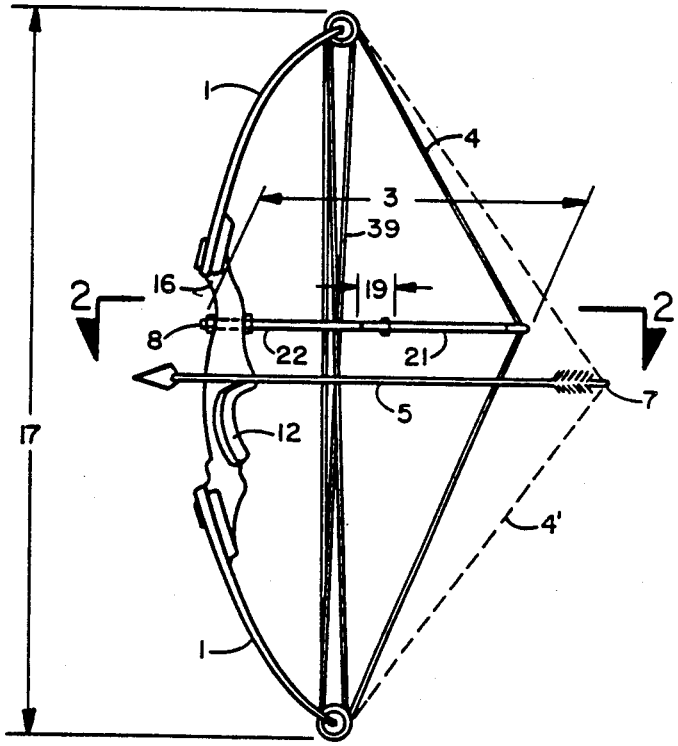
FIG. 1—Elevation view showing a bow and arrow and mounted bow cocking apparatus.

FIG. 1—Elevation view showing a bow and arrow and mounted bow cocking apparatus wherein:
1—Flex bow legs.
3—Bow cocking apparatus.
4—Bow shooting string (4'—phantom bow string in full cocked position).
5—Arrow.
6—Nock in rear of aft leg mount for bow string.
7—Nocked arrow.
8—Thread mount on forward end of forward leg.
12—Bow handle grip.
18—Bow string mounted in nock on rear of aft leg.
21—Bow cocking leg aft mount.
22—Bow cocking leg forward mount.

Figure 2:
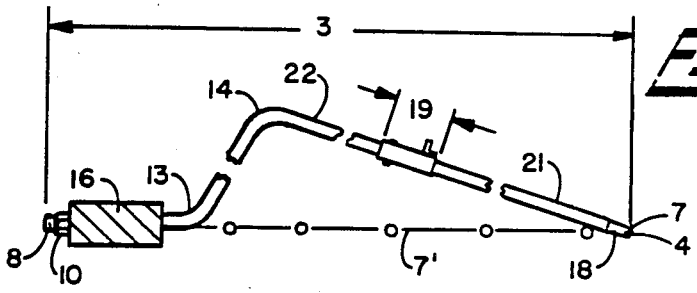
FIG. 2—Plan view showing bow cocking apparatus mounted on the bow, and bow shooting string line of travel.

FIG. 2—Plan view showing bow cocking apparatus mounted on the bow, and bow shooting string line of travel.
3—Bow cocking apparatus (assembled).
4—Bow string.
7—Nocked arrow.
7'—Bow string line of travel.

8—Thread mount on forward end of forward leg mount.
9—Bow cocking apparatus mount on bow handle segment.
10—Nut threaded on thread section 8.
12—Bow handle.
13—Front offset angle of cocking apparatus.
14—Rear offset angle of cocking apparatus.
16—Mount location on bow of cocking apparatus.
18—Bow string mount nock on rear of aft leg.
19—Bow cocking apparatus, spring hinge.
21—Bow cocking and stop assembly aft mount leg.
22—Bow cocking forward mount leg.

Figure 3:
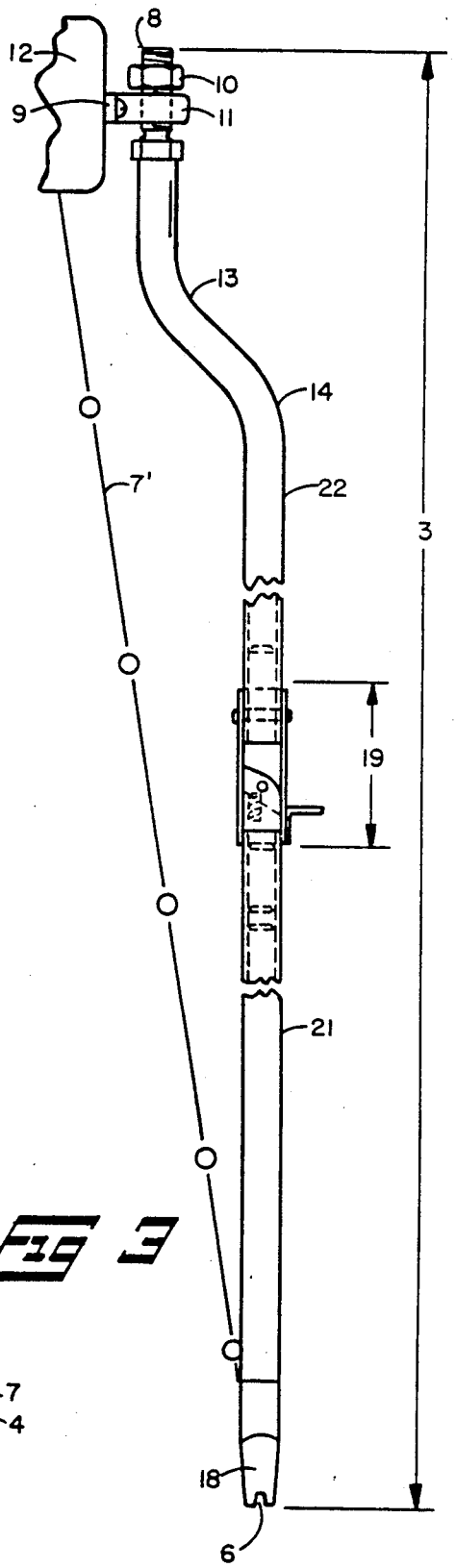
FIG. 3—Enlarged plan view of bow cocking apparatus and bow shooting string nocked in cocking apparatus.

FIG. 3—Enlarged plan view of bow cocking apparatus and bow shooting string nocked in cocking apparatus.
3—Bow cocking assembly.
6—Nock in rear of aft leg mount.
7'—Bow string line of travel.
8—Thread mount on forward end of forward leg.
10—Nut threaded on thread section 8.
11—Mount clamp on bow handle for cocking apparatus.
12—Bow handle.
13—Front offset angle of cocking apparatus.
14—Rear offset angle of cocking apparatus.
18—Bow string mount nock on rear of aft leg.
19—Bow cocking apparatus hinge, spring and stop assembly.
21—Bow cocking aft mount leg.
22—Bow cocking forward mount leg.
9—Bow cocking apparatus mount on bow handle segment.

Figure 4:
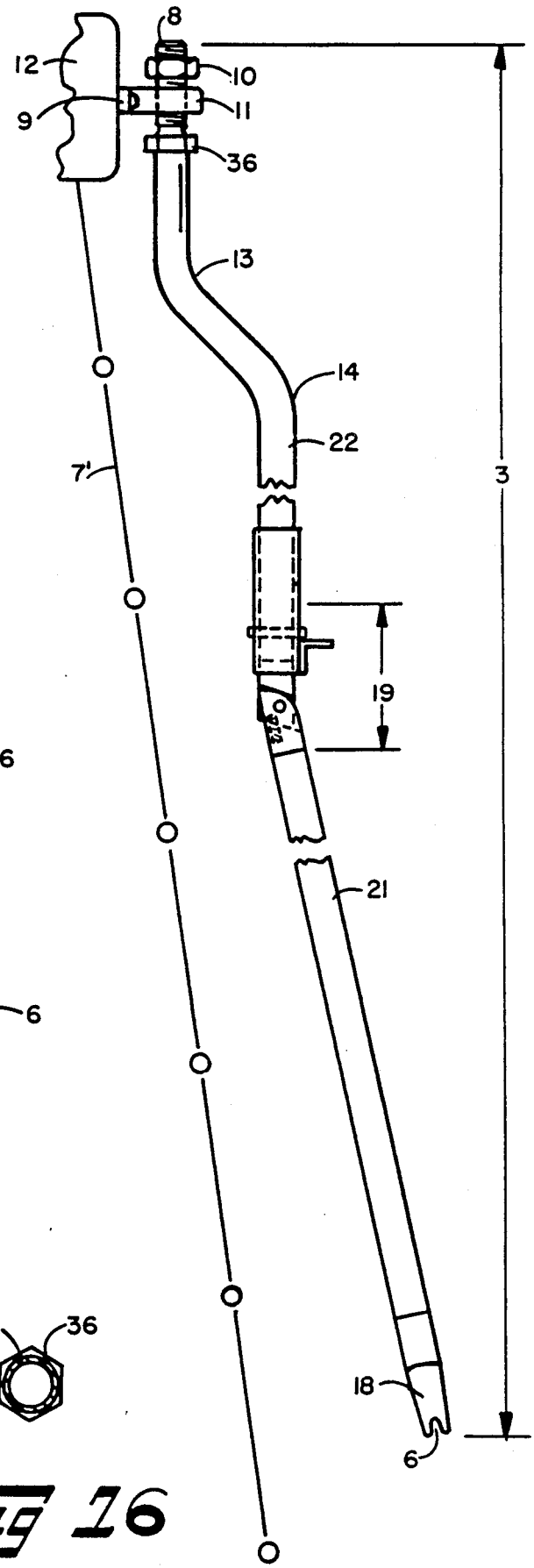
FIG. 4—Enlarged plan view of bow cocking apparatus, in full cocked position released from bow shooting spring.

FIG. 4—Enlarged plan view of bow cocking apparatus, in full cocked position released from bow shooting spring.
3—Bow cocking apparatus assembly.
6—Notch in rear of aft leg mount.
7'—Bow string line of travel.
8—Thread mount on forward end of forward leg.
10—Nut threaded on thread section 8.
11—Mount clamp on bow handle for cocking apparatus.
12—Bow handle.
13—Front offset angle on front leg of cocking apparatus.
14—Rear offset angle on front leg of cocking apparatus.
18—Bow string mount nock on rear of aft leg.
19—Bow cocking apparatus hinge spring and stop.
21—Bow cocking aft assembly mount leg.
22—Bow cocking forward mount leg.
9—Bow cocking apparatus mount on bow handle segment.

Figure 5:
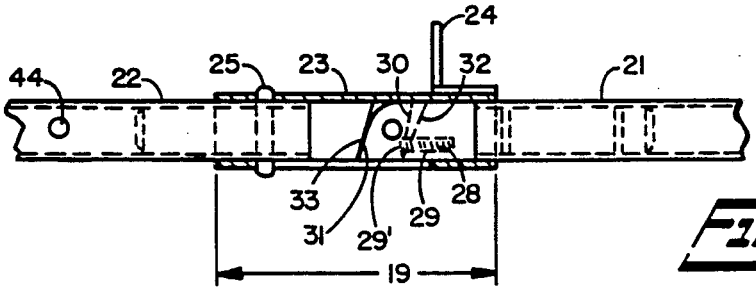
FIG. 5—Enlarged plan view of bow cocking apparatus in partly cocked position, safety position.

FIG. 5—Enlarged plan view of bow cocking apparatus in partly cocked safety position.
19—Bow cocking apparatus spring hinge and stop assembly.
21—Bow cocking aft mount leg.
22—Bow cocking front mount leg.
23—Bow cocking safety lock sleeve.
24—Bow cocking safety lock tab.
25—Pin stop for safety lock sleeve.
27—Hinge pin connecting forward and aft leg mount.
28—Compression coil spring.
29',29—Coil spring chamber forward leg and aft leg.
30—Male stop face on rear of forward leg.
31—Forward face of bow cocking aft mount leg.
32—Angle stop face of aft bow cocking leg.
33,33'—Angle stop face of forward bow cocking leg.
44—Pin for slip fit of leg forward mount to hinge section.

Figure 6:
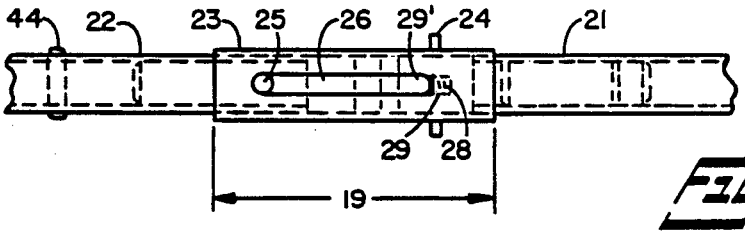
FIG. 6—Enlarged elevation view of bow cocking apparatus in partly cocked safety position.

FIG. 6—Enlarged elevation view of bow cocking apparatus in partly cocked safety position.
19—Bow cocking apparatus spring, hinge and stop assembly.
21—Bow cocking aft mount leg.
22—Bow cocking front mount leg.
23—Bow cocking safety lock sleeve.
24—Bow cocking safety lock tab.
25—Pin stop for safety lock sleeve.
26—Slot in safety sleeve.
28—Compression coil spring (ghost location).
29—Coil spring chamber aft leg (ghost location).
44—Pin for slip fit of leg forward mount to hinge section.

Figure 7:
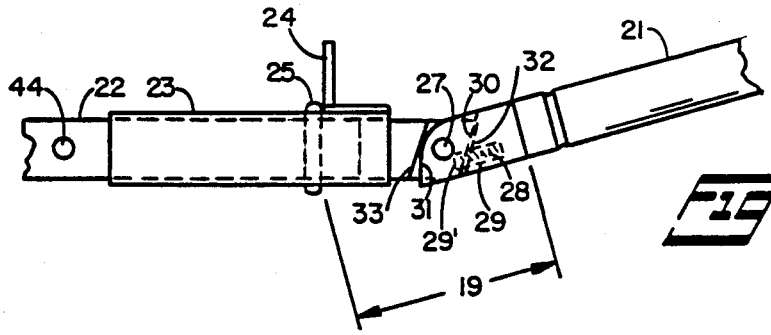
FIG. 7—Enlarged plan view of bow cocking apparatus in released position on full cocking of the bow and arrow, with safety sleeve in release position.

FIG. 7—Enlarged plan view of bow cocking apparatus in released position on full cocking of the bow and arrow, safety sleeve in release position.
19—Bow cocking apparatus spring, hinge and stop assembly.
21—Bow cocking aft mount leg.
22—Bow cocking front mount leg.
23—Bow cocking safety lock sleeve.
24—Bow cocking safety lock tab.
25—Pin stop for safety lock sleeve.
27—Hinge pin connecting forward and aft leg mount.
28—Compression coil spring.
29,29'—Coil spring chamber.
30—Male stop face on rear of forward leg.
31—Forward faces of bow cocking aft mount leg.
32—Angle stop face of aft bow cocking leg.
33—Angle stop face of forward bow cocking leg.
44—Pin for slip fit of leg forward mount to hinge section.

Figure 8:
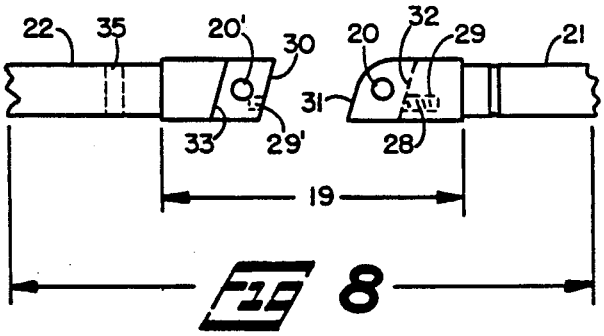
FIG. 8—Expanded plan view of hinge components of bow cocking legs.

FIG. 8—Expanded plan view of hinge components of bow cocking legs.
19—Bow cocking apparatus spring, hinge and stop assembly.
20,20'—Hinge pin holes.
21—Bow cocking aft mount leg.
22—Bow cocking front mount leg.
28—Compression coil spring (ghost location).
29,29'—Coil spring chamber (ghost location).
30—Male stop face on rear of forward leg.
31—Forward face of bow cocking aft mount leg.
32—Angle stop face of aft bow cocking leg.
33—Angle stop face of forward bow cocking leg.
35—Hole for mount of stop pin 25.

Figure 9:
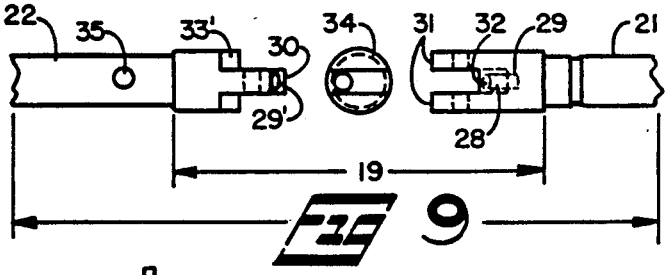
FIG. 9—Expanded elevation view of hinge components.

FIG. 9—Expanded elevation view of hinge components.
21—Bow cocking aft mount leg.
22—Bow cocking front mount leg.
28—Compression coil spring (phantom view).
29,29'—Coil spring chamber (phantom view).
30—Male stop face on rear of forward leg.
31—Forward faces of bow cocking aft mount leg.
32—Angle stop face of aft bow cocking leg.
33,33'—Angle stop face of forward bow cocking leg.
34—End view of rear of front leg mount.
35—Hole for mount of stop pin 25.

Figure 10:
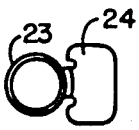
FIG. 10—End view of safety lock sleeve.

FIG. 10—End elevational view of safety lock sleeve.
23—Bow cocking safety lock sleeve.
24—Bow cocking safety lock sleeve tab.

Figure 11:
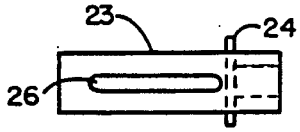
FIG. 11—Elevation view of safety lock sleeve.

FIG. 11—Elevation view of safety lock sleeve.
23—Bow cocking safety lock sleeve.
24—Bow cocking safety lock sleeve tab.

26—Slot in safety lock sleeve.

Figure 12:
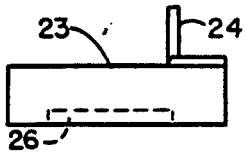
FIG. 12—Plan view of safety sleeve.

FIG. 12—Plan view of safety lock sleeve.

23—Bow cocking safety lock sleeve.

24—Bow cocking safety lock sleeve tab.

26—Phantom of slot in safety lock sleeve.

Figure 13:
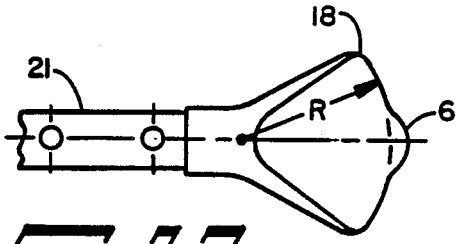
FIG. 13—Elevation view of bow string nock on rear end of bow cocking aft leg mount.

FIG. 13—Elevation view of bow string nock on rear end of bow cocking aft leg mount.

6—Nock on rear of aft leg mount.

18—Bow string guide nock.

21—Bow cocking aft mount leg.

R—Radius of nock base.

Figure 14:
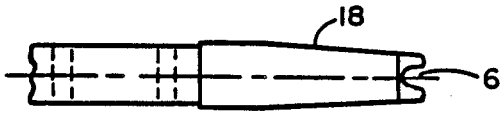
FIG. 14—Plan view of bow string nock of bow cocking apparatus.

FIG. 14—Plan view of bow string nock of bow cocking apparatus.

6—Nock on rear of aft leg mount.

18—Bow string guide nock.

21—Bow cocking aft mount leg.

Figure 15:
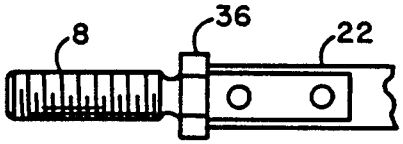
FIG. 15—Threaded end section of forward leg mount of bow cocking apparatus.

FIG. 15—Threaded end section of forward leg mount of bow cocking apparatus.

8—Thread section of front end of forward leg mount.

22—Bow cocking leg forward mount.

36—Hex section of front end of forward leg mounts.

Figure 16:
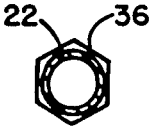
FIG. 16—End view of threaded end section of forward leg mount and hex section.

FIG. 16—End view of threaded end section of forward leg mount and hex section.

22—Bow cocking leg forward mount.

36—Hex section of front end of forward leg mount.

Figures 17, 18, 19, 20:
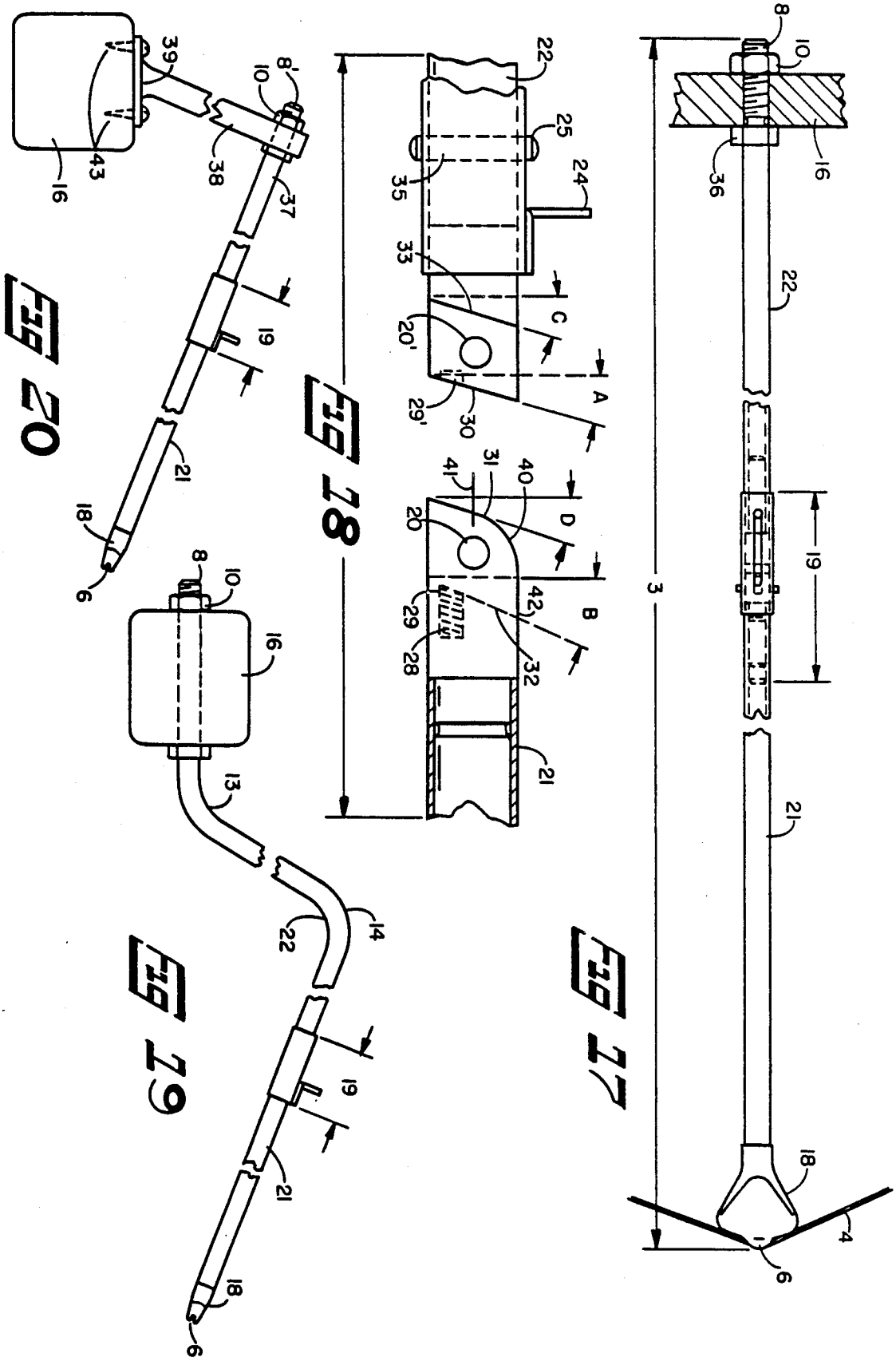
FIG. 17—Elevation view of bow cocking apparatus assembly.
FIG. 18—Enlarged expanded plan view of hinge components.
FIG. 19—Enlarged plan view of cocking apparatus mounted in through hole in bow handle showing offset angles of bow cocking leg forward mount.
FIG. 20—Enlarged plan view of cocking apparatus mounted on bow handle angle bracket and straight bow cocking leg forward mount.

FIG. 17—Elevation view of bow cocking apparatus assembly.

3—Bow cocking apparatus assembly.

4—Bow shooting spring.

6—Nock in rear of aft leg mount for bow string.

8—Thread mount on forward end of forward leg mount.

10—Nut threaded on thread section 8.

16—Bow handle.

18—Bow string mount nock base on rear of aft leg.

19—Bow cocking apparatus spring, hinge and stop assembly.

21—Bow cocking leg aft mount.

22—Bow cocking leg forward mount.

FIG. 18—Enlarged expanded plan view of hinge components.

20,20'—Hinge pin holes.

21—Bow cocking aft leg mount.

22—Bow cocking front leg mount.

23—Bow cocking safety lock sleeve.

24—Bow cocking safety lock sleeve tab.

25—Pin stop for safety lock sleeve.

28—Compression coil spring.

29,29'—Coil spring chambers in front and aft leg mount mating segments.

30—Male stop face on rear of forward leg.

31—Forward faces of bow cocking aft mount leg.

32—Angle stop face of aft bow cocking leg.

33—Angle stop face of forward bow cocking leg.

20,20'—Hinge pin holes.

35—Hole for mount of stop pin 25.

40—Arc on aft leg mount hinge segment.

41—Boundary of arc 40.

42—Boundary of arc 40.

A—Angle of about 15 degrees from vertical.

B—Angle of about 25 degrees from vertical.

C—Angle of about 15 degrees from vertical.

D—Angle of about 15 degrees from vertical or to be same as angle C.

FIG. 19—Enlarged plan view of cocking apparatus mounted in through hole in bow handle showing offset angles of bow cocking leg forward mount.

6—Nock in rear of aft leg mount.

8—Thread mount on forward end of forward leg.

10—Nut threaded on thread section 8.

13—Front offset angle on front leg of cocking apparatus.

14—Rear offset angle on front leg of cocking apparatus.

16—Bow handle.

18—Bow string mount nock on rear aft leg.

19—Bow cocking apparatus hinge, spring and stop assembly.

21—Bow cocking aft mount leg.

22—Bow cocking forward mount leg.

FIG. 20—Enlarged plan view of cocking apparatus mounted on bow handle angle bracket and straight bow cocking leg forward mount.

8'—Threaded segment of front leg mount.

16—Bow handle.

19—Bow cocking apparatus hinge, spring and stop assembly.

21—Bow cocking aft mount leg.

37—Bow cocking front mount leg.

38—Angled extended arm anchored.

39—Base of angled extended arm.

43—Screws holding base of angled extended bracket arm.

10—Nut threaded on thread section 8.

6—Nock in rear of aft leg mount.

18—Bow string mount nock on rear of aft leg.

DETAILED DESCRIPTION OF INVENTION

The invention can be described as a bow cocking apparatus comprising a bow/and bow string 4, and a bow cocking apparatus 3, assembly of a bow cocking leg forward mount 22 and a bow cocking aft mount leg 21 and the aft mount leg 21 is attached to the bow cocking leg forward mount 22 by a hinge 19 attached to the rear end of the leg forward mount 22, and the front end of the aft mount leg 21, and the hinge 19 comprised of two segments FIGS. 5, 6, 7, 8 and 9, one segment having a male section 30 and the other hinge segment having a female section 31 and a hinge pin 27 connecting the two hinge segments FIG. 5 with a coil spring chamber 29,29' extending between the hinge segments and a compression coil spring 28 mounted in the coil spring chamber 29,29' and the coil spring chamber 29,29' offset inward from the hinge pin 27 FIG. 5 toward the bow string 4, and a bow string mount nock 6 on the rear 18 of the aft mount leg 21 and the leg forward mount 22 of the bow cocking apparatus 3 attached offset to the handle FIG. 2 of the bow and the bow string mount nock 6 on the rear of the aft mount leg 21 extending to the bow string 4, FIG. 1 in partly cocked position, and the compression coil spring 28 forcing the aft leg mount 21 outwards on release of the bow string 4 from the nock 6 of the aft mount leg 21.

This invention of a bow cocking apparatus can be mounted on a left hand or right hand archery bow, or on either end of the archery bow grip, to be above or below the knocked arrow.

In the description which follows, the bow cocking apparatus is meant to be limited to less than full cocking of the bow and arrow nocked on the bow string. For practical purposes, this less than full cocking means partly cocking preferably to three quarters of full cocking, the partly cocked apparatus may be partly cocked from fifty to ninety percent.

This invention of bow cocking apparatus can best be described by indicating its utility and its connection to an archery bow as shown in FIGS. 1 and 2, wherein the bow comprises bow flex arms 1, connected to bow handle 16 and bow handle grip 12 as part of the bow handle. Bow cocking apparatus assembly 3 is attached to bow handle 16.

The bow cocking apparatus assembly 3, is an assembly of bow cocking leg forward mount 22 and, front offset angle on front leg of cocking apparatus 13, and rear offset angle on front leg of cocking apparatus 14.

The above offset angles 13 and 14 are preferably each 45 degrees, which extends the bow cocking apparatus 3 outwards from the travel of the bow string on shooting an arrow.

A thread mount 8 on forward end of forward leg is the means for mounting the bow cocking assembly 3 to the bow handle 16 by means of a nut 10, threaded on thread mount 8, as shown in FIG. 19. Bow cocking apparatus spring, hinge and stop assembly 19 is attached to the rear end of bow cocking leg forward mount 22 and to the front end of bow cocking aft mount leg 21, thus bow cocking apparatus of compression coil spring, hinge and stop assembly 19 joins the bow cocking leg forward mount 22 and bow cocking aft mount leg 21.

The offset angles 13 and 14 of the front leg mount 21, are such as to give clearance of the bow string 4 to its line of travel as indicated by legend 7'. The offset angles are 45 degrees, each angle in opposite direction to the other (see FIGS. 3, 4, 19).

Bow string mount nock on rear of aft leg 18 as indicated in FIG. 13, elevation view, provides an arc surface of about one inch for nesting of the bow string 4 to prevent excessive wear of the string. The nock 6 in the rear of aft leg mount is to provide added safety to prevent the bow string 4 from slipping off of the bow string mount nock 18. The radius R of the above arc surface is preferably about 2 or 3 inches.

The bow cocking apparatus spring hinge, and stop assembly 19 is an assembly of a male stop face 30 on rear of forward leg and angle shoulder stop faces 33,33' forward of stop face 30 on rear of forward leg. Stop face 30 is at an angle of about 15 degrees from perpendicular as shown in FIG. 18. Angle shoulder stop faces 33,33' forward of stop face 30 also have an angle of about 15 degrees. Thus the angles of 30 and 33,33' are essentially the same. The above described male section fits into the angle shoulder female stop face of aft bow cocking leg 32 as shown in expanded plan view FIGS. 8 and 9. The angle B of female stop face 32 of aft bow cocking leg is about 25 degrees. This angle B is greater than angle A to allow limited pivoting of the aft leg mount 21. Forward female shoulder faces 31 of bow cocking aft mount are at an angle of about 25 degrees. The forward female shoulder faces 31,31' extend in a straight line for about one-half the diameter of the hinge joining the forward and aft legs, and arc 40 as shown in FIG. 18 extends from faces 31,31' location 41 to location 42. The radius of this arc is approximately equal to the radius of the aft leg mount tubing or rod, and is of such magnitude to allow the compression spring to activate the hinge to swing the aft leg outward from the bow string, on release of the nock 6 of the rear of the aft leg from the bow string 4, on full cocking of bow and arrow.

The bow cocking apparatus assembly 3 can be mounted on a bow handle by different methods, one method being, a bow cocking apparatus mount on bow handle segment 9 by means of a mount clamp 11 on bow handle for cocking apparatus. The mount clamp 11 provides a mount 9 having a hole therein for insertion of thread on forward end of forward leg 8, and subsequent threading of nut 10 on the thread section 8.

Referring now to FIG. 1, legend 17 includes compound bow, bow string, arrow and cocking apparatus in elevational view, and dashed line 4' indicates the bow string in supposed full cocked position.

In FIG. 2 is a plan view of the cocking apparatus 3 mounted on the bow handle 16. The bow string 4 is in the nock 6 of bow string mount nock on rear of aft leg 18, and 7' is the line of travel of the bow string.

The bow cocking apparatus of hinge, spring and stop assembly 19 is shown in plan view in FIGS. 3 and 4. FIG. 3 shows the apparatus in cocked position with the hinge assembly 19 mounted to swing outwardly from the bow string 4, on full cocking as shown in FIG. 4. Compression coil spring 28, actuates the hinge to swing aft leg outward.

In regard to the compression coil spring 28, coil spring chamber 29,29' for actuation of the swing outwardly of the bow cocking aft leg mount 21, the coil spring chamber 29,29' is adjacent to the hinge pin 27, and as shown in the plan view of FIGS. 5 and 7 the coil spring chamber 29,29' and compression coil spring 28 are located inward toward the bow string such that the aft leg mount 21 swings outward.

The hinge pin holes 20,20' of the hinge sections as shown in enlarged expanded plan view in FIG. 18 when aligned by fitting the rear end of bow cocking leg forward mount which is a male end, into the female end of the forward end of the aft leg mount 21, the hinge pin connecting forward and aft leg mount 27 is inserted into the aligned hinge pin holes 20,20'.

In order to cause the bow cocking leg 21, to swing outward, compression coil spring 28 is mounted in coil spring chamber 29,29'. This coil spring chamber 29,29' adjacent to hinge pin 27 extends into the male and female ends of the forward and aft leg as described above, and as shown in FIGS. 5, 7, and 18.

There is a safety device incorporated in this apparatus which is a bow cocking safety lock sleeve 23 which is a tubular sleeve and a slot in this safety lock sleeve 26 to limit back and forth travel to enclose the hinge apparatus. To limit the back and forth movement of the safety lock sleeve 23, pin stop for safety lock sleeve 25 in hole 35 extends through the slot 26. To aid in moving the safety lock sleeve 23, bow cocking safety lock sleeve tab 24 is mounted on the safety sleeve 23.

In FIGS. 5 and 6, safety lock sleeve 23 is shown in safety lock position to prevent actuation of the hinge, on partial cocking.

In FIG. 9, end view of rear of front leg mount 34 is shown.

The front of forward leg mount 22 has a hex head 36 in back of thread on forward end of forward leg 8.

There are several ways for the bow cocking apparatus to be mounted on a bow handle. As discussed above, offset angles 13 and 14 on the front leg of cocking apparatus are shown in various figures such as FIGS. 2, 3, 4, 19. In FIG. 20 is shown straight bow cocking leg forward mount 37 mounted on bracket mount 38 on the bow handle, and the bracket mount attached to bow handle by screws 43 on the base 39 of bracket 38. The bracket 38 is mounted at an offset angle such that the bow shooting string 4 has clear travel to shoot an arrow, when the aft leg mount 21 is swung outward on full cocking of an arrow in the bow.

It is to be further pointed out that when the bow is cocked with the apparatus 3, the bow string 4 pulls against the hinge in its straight alignment of the forward and aft mounted legs, and the aft leg mount 21 will swing outward only on full cocking of the bow string and arrow. Swing outward means swinging away from the bow shooting string to allow free travel of the string on shooting the arrow.

In FIGS. 5, 6 and 7, legend 44 indicates a pin for slip fit of leg forward mount to hinge section. The pin 44 is to guide bow cocking leg forward mount 22 which may be a tubular section, into the hinge section. By having such slip fit assembly the bow cocking apparatus assembly 3 may be disassembled when removed from the bow handle 16, and reassembled on mounting on the bow.

The above described bow cocking apparatus can be mounted and used on a compound bow or on the standard non-compound bow of only a bow and bow shooting string mounted thereon.

The apparatus of this invention may also be mounted on either side of a bow for left or right hand shooting.

On mounting of this bow cocking apparatus on a compound bow the forward leg mount may be used to dampen the power strings vibration by making contact with the power strings.

To aid in locating the nock of the aft leg mount on the bow string, a nocking point indicator may be set on the bow shooting string, which nocking point indicator would be in addition to an arrow nocking point indicator if desired. Nocking point indicators on the bow string are well known to those knowledgeable in the art of archery.

In all of the above description, swing outwards and similar words mean away from the bow and string plain.

The handle of the bow is to be differentiated from the grip. The handle includes the areas on both ends of the grip or handle grip.

The drawing legends identify the components of this invention, and with the description enables those knowledgeable in the art to make the apparatus of this invention.

Having described my invention, I claim:

1. Archery bow cocking apparatus comprising:

(a) a bow and bow string and (b) bow cocking apparatus assembly including (c) a bow cocking leg forward mount (d) and two offset angles on said leg forward mount (e) a bow cocking aft mount leg and (f) said aft mount leg attached to said bow cocking leg forward mount by means of a hinge attached to a rear end of said leg forward mount and a front end of said aft mount leg and (g) said hinge comprised of two segments, one segment comprising a male section on said rear end of said leg forward mount and the other hinge segment comprising a female section on said front end of said aft mount leg and (h) a hinge pin connecting the two said hinge segments and (i) a coil spring chamber extending between said hinge segments and (j) a compression coil spring mounted in said coil spring chamber and (k) said coil spring chamber offset inward from said hinge pin, toward said bow string and (l) a bow string mount nock on a rear end of said aft mount leg and (m) said leg forward mount of said bow cocking apparatus attached offset to a handle of said bow and (n) said bow string mount nock on said rear end of said aft mount leg extending to said bow string in partly cocked position, and (o) said compression coil spring forcing said aft leg mount outwards on release of said bow string from the nock of said aft mount leg, on full cocking of said bow and spring.

2. Archery bow cocking apparatus of claim 1 wherein the improvement comprises:

(a) a bow cocking safety lock sleeve and (b) said safety lock sleeve mounted to reciprocate over and away from said hinge connecting the leg forward mount and aft mounted leg, (c) and a pin stop on said hinge, to limit said reciprocating movement of said safety lock sleeve over and away from said hinge.

3. Archery bow cocking apparatus wherein the improvement comprises:

(a) a bow and bow string (b) bow cocking apparatus assembly mounted on a bow handle (c) a bow cocking leg forward mount (d) said bow cocking leg forward mount being a straight leg mounted on an angle bracket attached to said bow handle and (e) a bow cocking aft mount leg and (f) said aft mount leg attached to said bow cocking leg forward mount by means of a hinge attached to a rear end of said leg forward mount and a front end of said aft mount leg and (g) said hinge comprised of two segments comprising a male section on said rear end of said leg forward mount and (h) the other hinge segment comprising a female section on said front end of said aft mount leg and (i) a hinge pin connecting the two said hinge segments and (j) a coil spring chamber extending between said hinge segments and (k) a compression coil spring mounted in said coil spring chamber, and (l) said coil spring chamber offset inward from said hinge pin, toward said bow string and (m) a bow string mount nock on a rear end of said aft mount leg and (n) said bow string mount nock on said rear end of said aft mount leg extending to said bow string in partly cocked position and (o) said compression coil spring forcing said aft leg mount outwards on release of said bow string from the nock of said aft mount leg on full cocking of said bow and string.

4. Archery bow cocking apparatus of claim 1 or 3, wherein the improvement comprises:

(a) said male section having a male stop face and (b) male shoulder stop faces adjacent to on both sides of said male section and (c) the other section of said hinge being attached to the front end of said aft leg mount having an angle shoulder female stop face and (d) forward female shoulder faces on said female section attached to the front end of said aft leg mount, said female shoulder faces extending outward from said female stop face and (e) said male and female sections of the hinge connected by said hinge pin and (f) said male stop face and male shoulder stop faces having an outward extending angle of about 15 degrees and (g) said female stop face and shoulder faces having an outward extending angle of about 25 degrees and (h) said male and female faces limiting hinge movement.

5. Archery bow cocking apparatus comprising:

(a) a bow and bow string and (b) bow cocking apparatus assembly including (c) a bow cocking leg forward mount (d) and two offset angles on said leg forward mount (e) a bow cocking aft mount leg and (f) said aft mount leg attached to said bow cocking leg forward mount by means of a hinge attached to a rear end of said leg forward mount and a front end of said aft mount leg and (g) said hinge comprised of two segments, one segment comprising a male section on said rear end of said leg forward mount and the other hinge segment comprising a female section on said front end of said aft mount leg and (h) a hinge pin connecting the two said hinge segments and (i) a coil spring chamber extending between said hinge segments and (j) a compression coil spring mounted in said coil spring chamber and (k) said coil spring chamber offset inward from said hinge pin, toward said bow string and (l) a bow string mount nock on a rear end of said aft mount leg and (m) said leg forward mount of said bow cocking apparatus attached offset to a handle of said bow and (n) said bow string mount nock on said rear end of said aft mount leg extending to said bow string in partly cocked position, and (o) said compression coil spring forcing said aft leg mount outwards on release of said bow string from the nock of said aft mount leg, on full cocking of said bow and spring, and (p) a bow cocking safety lock sleeve and (q) said safety lock sleeve mounted to reciprocate over and away from said hinge connecting the leg forward mount and aft mounted leg, (r) and a pin stop on said hinge, to limit said reciprocating movement of said safety lock sleeve over and away from said hinge.

* * * * *